US012104266B2

(12) United States Patent
Choi et al.

(10) Patent No.: US 12,104,266 B2
(45) Date of Patent: Oct. 1, 2024

(54) PLATING APPARATUS HAVING CONDUCTIVE LIQUID AND PLATING METHOD

(71) Applicant: Samsung Electronics Co., Ltd., Suwon-si (KR)

(72) Inventors: Jaewon Choi, Incheon (KR); Jaesik Chung, Yongin-si (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 0 days.

(21) Appl. No.: 17/974,239

(22) Filed: Oct. 26, 2022

(65) Prior Publication Data

US 2023/0183881 A1 Jun. 15, 2023

(30) Foreign Application Priority Data

Dec. 14, 2021 (KR) ..... 10-2021-0178677

(51) Int. Cl.
*C25D 17/00* (2006.01)

(52) U.S. Cl.
CPC ..... *C25D 17/004* (2013.01); *C25D 17/001* (2013.01); *C25D 17/007* (2013.01)

(58) Field of Classification Search
None
See application file for complete search history.

(56) References Cited

U.S. PATENT DOCUMENTS 6,860,769 B2 3/2005 Liu et al.
2004/0124088 A1* 7/2004 Tsuboi ..... H01L 21/2007 205/147
2006/0042934 A1* 3/2006 Talieh ..... C25D 17/001 257/E21.175
2006/0226018 A1 10/2006 Iwazaki
2007/0158202 A1* 7/2007 Nagai ..... C25D 7/123 205/101
2008/0029850 A1 2/2008 Hedler et al.
2021/0292928 A1* 9/2021 Niwa ..... C25D 11/022

FOREIGN PATENT DOCUMENTS

| | | | |
|---|---|---|---|
| JP | 2002/275696 | A | 9/2002 |
| JP | 4873644 | B2 | 2/2012 |
| KR | 100564946 | B1 | 3/2006 |
| KR | 100756160 | B1 | 9/2007 |
| KR | 101043229 | B1 | 6/2011 |
| KR | 2018/0089647 | A | 8/2018 |
| KR | 102263948 | B1 | 6/2021 |

OTHER PUBLICATIONS

English translation JP 2002275696 (Year: 2002).*

* cited by examiner

*Primary Examiner* — Stefanie S Wittenberg
(74) *Attorney, Agent, or Firm* — Harness, Dickey, & Pierce, P.L.C

(57) ABSTRACT

A plating apparatus may include a body, a lip seal structure connected to the body, and a conductive liquid. The body may include a cathode. The lip seal structure may be configured to hold a wafer. The lip seal structure may include a bottom portion, a contact portion connected to the bottom portion and contacting the wafer, and at least one partition structure protruding from an upper surface of the bottom portion. The conductive liquid may cover the upper surface of the bottom portion and may be configured to electrically connect the cathode and the wafer.

19 Claims, 13 Drawing Sheets

PLATING APPARATUS HAVING CONDUCTIVE LIQUID AND PLATING METHOD

CROSS-REFERENCE TO THE RELATED APPLICATION

This application claims priority from Korean Patent Application No. 10-2021-0178677, filed on Dec. 14, 2021 in the Korean Intellectual Property Office, the disclosure of which is incorporated herein by reference in its entirety.

BACKGROUND

1. Field

Example embodiments of the disclosure relate to a plating apparatus having a conductive liquid and/or a plating method.

2. Description of the Related Art

In accordance with miniaturization of a semiconductor device, technology for forming a conductive structure, such as a multilayer metal wiring, a through-hole via (THV) and a through-silicon via (TSV), has been adopted. For example, the conductive structure may be formed by a plating process. In accordance with a reduction in design rule of a semiconductor device, technology capable of securing reliability of the device while embodying a conductive structure having a reduced size using a thinner material is important.

SUMMARY

Example embodiments of the disclosure provide a plating apparatus and/or a plating method capable of enhancing reliability of a device.

According to an example embodiment, a plating apparatus may include a body including a cathode, a lip seal structure connected to the body and configured to hold a wafer, and a conductive liquid. The lip seal structure may include a bottom portion, a contact portion connected to the bottom portion and configured to contact the wafer, and at least one partition structure protruding from an upper surface of the bottom portion. The conductive liquid may cover the upper surface of the bottom portion and may be configured to electrically connect the cathode and the wafer to each other.

According to an example embodiment, a plating apparatus may include a body including a cavity at a surface configured to face a wafer, a lip seal structure, and a conductive liquid. The body may further include at least one cathode, at least one nozzle, and at least one level sensor in fluid communication with the cavity. The lip seal structure may be connected to the body and may be configured to hold the wafer. The lip seal structure may include a bottom portion, a contact portion connected to the bottom portion and configured to contact the wafer, and at least one partition structure protruding from an upper surface of the bottom portion. The conductive liquid may cover the upper surface of the bottom portion and may be configured to electrically connecting the cathode and the wafer to each other.

According to an example embodiment, a plating apparatus may include a substrate holder configured to hold a wafer, and a plating bath under the substrate holder. The substrate holder may include a body including a cavity at a surface configured to face the wafer, a spindle configured to rotate the body, a lip seal structure connected to the body, a pressing member, and a conductive liquid. The body may further include a cathode, a nozzle, and a level sensor in fluid communication with the cavity. The lip seal structure may be configured to support a first surface of the wafer. The lip seal structure may include a bottom portion, a contact portion connected to the bottom portion and configured to contact the wafer, and at least one partition structure protruding from an upper surface of the bottom portion. The pressing member may be configured to press a second surface of the wafer opposite the first surface of the wafer. The conductive liquid may cover the upper surface of the bottom portion and may be configured to electrically connect the cathode and the wafer to each other. The plating bath may include an electroplating chamber. The electroplating chamber may include a plating solution and an anode electrically connected to the plating solution.

According to an example embodiment, a plating method may include disposing a wafer on a substrate holder, the substrate holder including a lip seal structure configured to hold the wafer, and the lip seal structure including partition structures protruding from an upper surface of a bottom portion of the lip seal structure; pressing the wafer by a pressing member; supplying a conductive liquid onto the lip seal structure; dipping one surface of the wafer in a plating solution; and forming a conductive film on the one surface of the wafer.

DETAILED DESCRIPTION

Expressions such as "at least one of," when preceding a list of elements, modify the entire list of elements and do not modify the individual elements of the list. For example, "at least one of A, B, and C," and similar language (e.g., "at least one selected from the group consisting of A, B, and C") may be construed as A only, B only, C only, or any combination of two or more of A, B, and C, such as, for instance, ABC, AB, BC, and AC.

Figure 1:
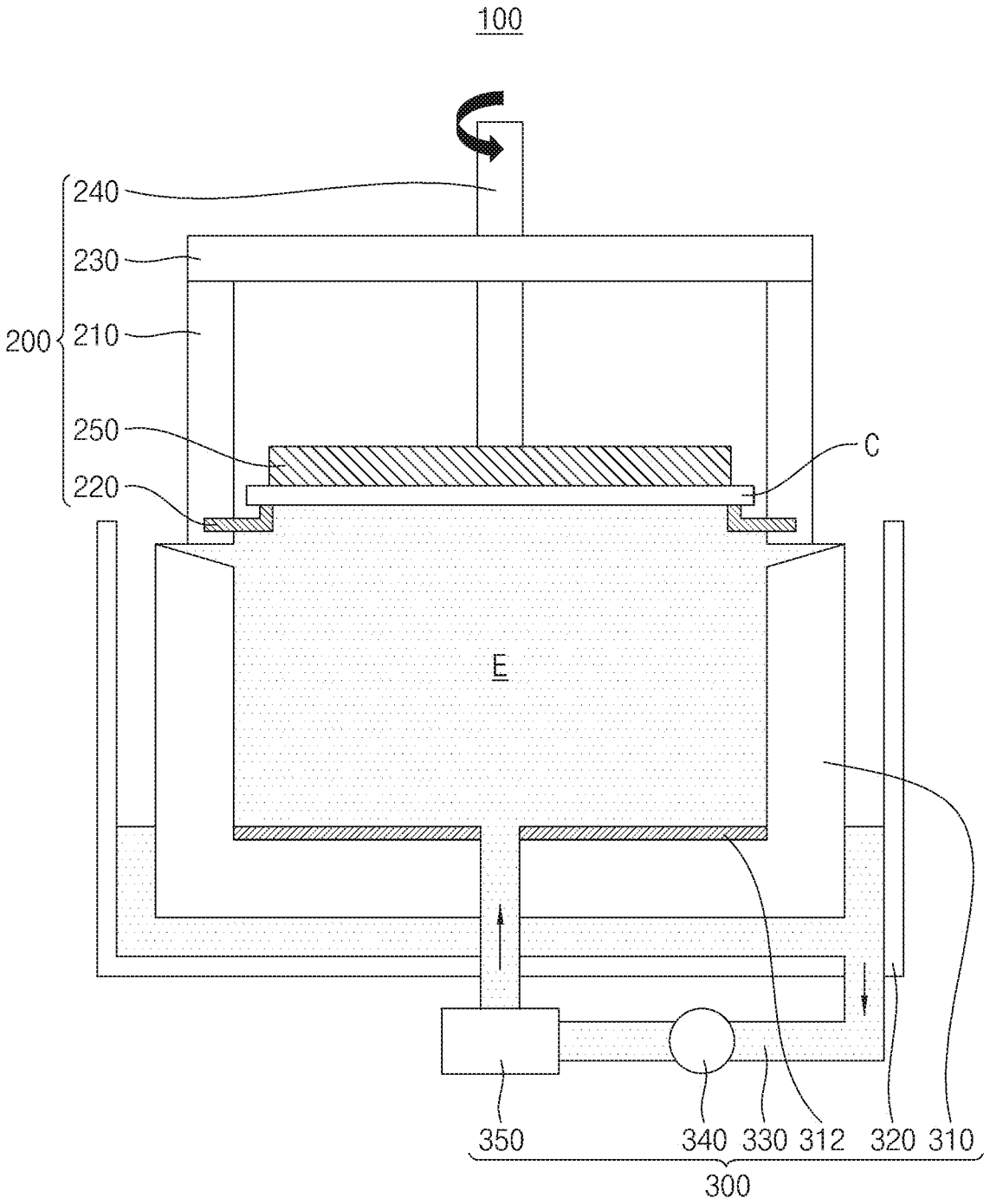
FIG. 1 is a cross-sectional view of a plating apparatus according to an example embodiment of inventive concepts.

FIG. 1 is a cross-sectional view of a plating apparatus according to an example embodiment of inventive concepts.

Referring to FIG. 1, a plating apparatus 100 may include a substrate holder 200 and a plating bath 300. In an embodiment, the plating apparatus 100 may be an apparatus for forming a plated film by reductively precipitating metal ions on a substrate or a wafer using the principles of electrolysis. The plated film may include metal such as copper (Cu), gold (Au), silver (Ag), platinum (Pt), etc. The substrate may include one of a silicon substrate, a quartz substrate, a ceramic substrate, etc.

The substrate holder 200 may include a body 210, a lip seal structure 220, an upper plate 230, a spindle 240, and a pressing member 250.

The body 210 may have a cylindrical shape with an interior being empty. One side of the body 210 may be connected to the lip seal structure 220. For example, a portion of the lip seal structure 220 may be buried in the body 210 and, as such, the body 210 may support the lip seal structure 220. The other side of the body 210 may be connected to the upper plate 230.

The lip seal structure 220 may support a carrier C to which a wafer (see FIG. 3) is attached. For example, one side of the lip seal structure 220 is supported by the body 210, and the other side of the lip seal structure 220 may support a bottom of the carrier C. In cross-sectional view, the lip seal structure 220 may have a bent shape. The carrier C may have a disc shape, and the lip seal structure 220 may extend in a horizontal direction along a circumference of the carrier C or the wafer. For example, in plan view, the lip seal structure 220 may have a ring shape or a donut shape.

The upper plate 230 may be connected to the body 210. For example, the upper plate 230 may cover an upper portion of the cylindrical body 210. The spindle 240 may have a bar shape or a circular column shape extending in a vertical direction, and may be connected to the pressing member 250 while extending through the upper plate 230. The spindle 240 may rotate in a horizontal direction and, as such, may rotate the substrate holder 200 and the carrier C. For example, when a plating process is performed, the spindle 240 may rotate all of the upper plate 230 connected thereto, the lip seal structure 220, and the carrier C supported by the lip seal structure 220. A motor (not shown) may rotate the spindle 240 and/or move the spindle 240 and/or body 210.

The pressing member 250 may be connected to one side of the spindle 240, and may press the carrier C. For example, before the plating process is performed, the spindle 240 may move in the vertical direction, thereby causing the pressing member 250 to be brought into close contact with the carrier C. Alternatively, a method, in which the upper plate 230 and the pressing member 250 are maintained in a fixed state, and the body 210 vertically moves to cause the pressing member 250 to be brought into close contact with the carrier C, may be implemented. The pressing member 250 may press a surface of the wafer opposite to a surface of the wafer to be formed with a plated film.

The plating bath 300 may contain a plating solution E therein, and may be disposed under the substrate holder 200. The plating bath 300 may include an electroplating chamber 310, an anode 312, a recovery chamber 320, a recovery line 330, a pump 340, and a heater 350. The heater 350 may include a device, such as an electric circuit heater or a lamp.

The electroplating chamber 310 may contain the plating solution E therein. For example, the electroplating chamber 310 may have a cylindrical shape having an open top surface, and the plating solution E may be contained in an interior of the electroplating chamber 310. The plating solution E may face the carrier C or the wafer. The plating solution E may be an electrolytic solution. For example, when a copper film is to be plated on the wafer, the plating solution E may include an aqueous solution of copper sulfate ($CuSO_4$).

The anode 312 may be disposed in the interior of the electroplating chamber 310. For example, the anode 312 may be disposed at an inner lower surface of the electroplating chamber 310 which has a cylindrical shape, and may contact the plating solution E. In an embodiment, the anode 312 may include copper (Cu). As will be described later, the cathode 212 may be disposed at the body 210, and the anode 312 and the cathode 212 may be connected to a power source (e.g., power circuit) and, as such, may receive current. As current is applied to the anode 312 and the cathode 212, a plated film may be formed on one surface of the wafer contacting the electroplating solution E by electrochemical reduction.

The recovery chamber 320 may be disposed outside the electroplating chamber 310. For example, the recovery chamber 320 may have a cylindrical shape having an open top surface, and may surround an outer side surface of the electroplating chamber 310 which has a cylindrical shape. Between the recovery chamber 320 and the electroplating chamber 310, there may be a space through which the plating solution E may flow. Through the space, the plating solution E may be recovered. For example, the recovery line 330, which communicates with the space, may be disposed under the recovery chamber 320, and may be connected to the pump 340 and the heater 350. The pump 340 may again supply the plating solution E to the electroplating chamber 310, and the heater 350 may heat the plating solution E to a temperature suitable for electrochemical reduction. For example, the plating solution E discharged from the recovery chamber 320 to the recovery line 330 may be moved to the interior of the electroplating chamber 310 via the pump 340 and the heater 350. The plating solution E overflowing the electroplating chamber 310 may again be discharged to the recovery chamber 320 and the recovery line 330.

Figure 2:
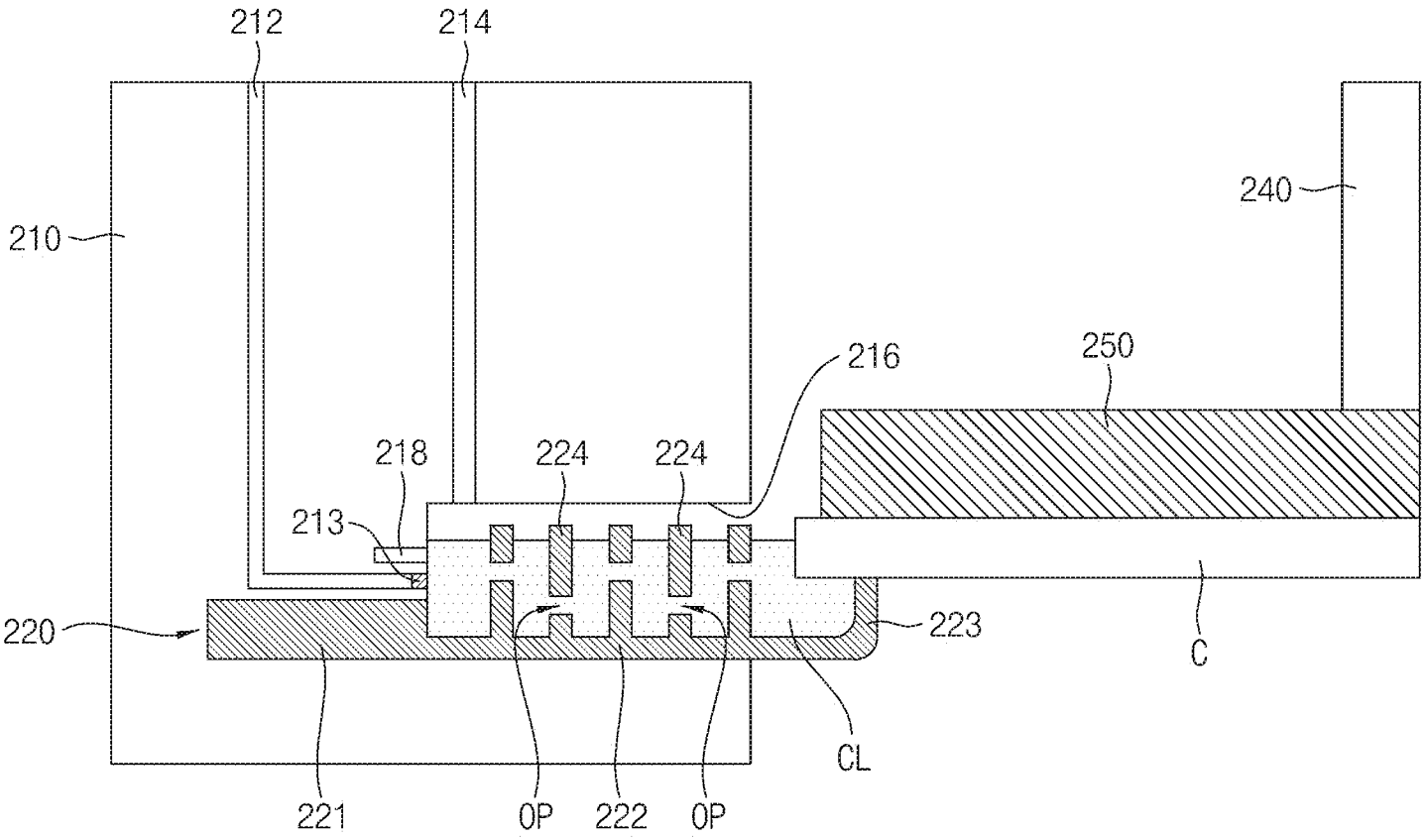
FIG. 2 is a cross-sectional view of a lip seal structure of the plating apparatus shown in FIG. 1.

FIG. 2 is a cross-sectional view of the lip seal structure 220 of the plating apparatus shown in FIG. 1.

FIG. 2 shows the pressing member 250 pressing one side of the carrier C, the spindle 240 connected to the pressing member 250, the lip seal structure 220 supporting the other side of the carrier C, and the body 210 connected to the lip seal structure 220. The plating device 100 according to example embodiments of inventive concepts may further include a conductive liquid CL on the lip seal structure 220. The conductive liquid CL may include at least one of an aqueous solution of copper sulfate ($CuSO_4$), deionized water (DIW), and sulfuric acid ($H_2SO_4$).

Referring to FIG. 2, the body 210 may include the cathode 212, a nozzle 214, a cavity 216, and a level sensor 218. The cathode 212, the nozzle 214, and the level sensor 218 may be buried in the body 210, and may be exposed to the cavity 216 which is formed at the body 210. For example, the cavity 216 may be formed at a side surface of the body 210 facing the carrier C, and the body 210 may have a structure in which the side surface is recessed in the horizontal direction.

The cathode 212 may have an L shape in cross-section, and one end of the cathode 212 may be exposed to the cavity 216. For example, the one end of the cathode 212 may be disposed at a side surface of the cavity 216, and may contact the conductive liquid CL in the cavity 216. The cathode 212 may be electrically connected to the conductive liquid CL, and may supply current to the conductive liquid CL. Although reference numerals "212" and "CL" are used as designating different elements in the specification, the designated elements may collectively function as a cathode. In an embodiment, the cathode 212 may include an anti-corrosive layer 213. For example, the anti-corrosive layer 213 may be disposed at the one end of the cathode 212 contacting the conductive liquid CL. The anti-corrosive layer 213 may limit and/or prevent the cathode 212 from corroding due to the conductive liquid CL. Both the cathode 212 and the anti-corrosive layer 213 may include a conductive material. In an embodiment, the cathode 212 may include copper (Cu), and the anti-corrosive layer 213 may include gold (Au).

The nozzle 214 may have a line shape extending in the vertical direction in cross-sectional view, and one end of the nozzle 214 may be exposed to the cavity 216. For example, the one end of the nozzle 214 may be disposed at the upper surface of the cavity 216. In an embodiment, the nozzle 214 may supply the conductive liquid CL to an interior of the cavity 216.

One end of the level sensor 218 may be disposed at the side surface of the cavity 216. Although the level sensor 218 is shown as being disposed at a higher level than the one end of the cathode 212 contacting the conductive liquid CL, example embodiments of the disclosure are not limited thereto. The level sensor 218 may be used to measure a liquid level of the conductive liquid CL. For example, when the liquid level of the conductive liquid CL is identified to be higher than a vertical level of the level sensor 218, a plating process may be performed. The level sensor 218 may include an instrument with processing circuitry for measuring the liquid level of the conductive liquid CL. The level sensor 218 may include at least one of a resistance sensing circuit, a capacitance sensing circuit, an optical sensor with a semiconductor device, and the like, but is not limited thereto.

The lip seal structure 220 may include a buried portion 221, a bottom portion 222, a contact portion 223, and partition structures 224. The buried portion 221 of the lip seal structure 220 may be buried in the body 210, and the lip seal structure 220 may be supported by the body 210 by virtue of the buried portion 221. The bottom portion 222 may be connected to the buried portion 221, and may extend in the horizontal direction. The bottom portion 222 may be disposed on a lower surface of the cavity 216, and a part of the bottom portion 222 may further extend outwardly of the cavity 216 toward the carrier C. The contact portion 223 may be connected to the bottom portion 222, and may support the carrier C. For example, one end of the bottom portion 222 may be connected to the buried portion 221, and the other end of the bottom portion 222 opposite to the one end of the bottom portion 222 may be connected to the contact portion 223. The bottom portion 222 may extend in the vertical direction, and may support a lower surface of the carrier C or the wafer.

The partition structures 224 may be disposed on the bottom portion 222, and may be disposed to be spaced apart from one another in the horizontal direction. For example, the partition structures 224 may protrude from an upper surface of the bottom portion 222, and may have a bar shape in cross-sectional view. In an embodiment, each partition structure 224 may include at least one opening OP. In an embodiment, respective openings OP of the partition structures 224 may be disposed at different vertical levels. For example, the openings OP formed at adjacent ones of the partition structures 224 may be disposed to be misaligned from each other in the horizontal direction, and may be disposed at different vertical levels, respectively. The conductive liquid CL may move among the openings OP of the partition structures 224 and, as such, may be filled to a uniform liquid level over the bottom portion 222. In a plating process, the body 210 may be rotated by the spindle 240 and, as such, there may be a possibility that the conductive liquid CL may be biased in a direction away from the carrier C by centrifugal force. In this case, the contact area between the wafer and the conductive liquid CL may be reduced, or the wafer does not contact the conductive liquid CL and, as such, a sufficient amount of current may not be supplied to the wafer. However, the plating apparatus 100 according to example embodiments of inventive concepts may prevent or reduce biasing of the conductive liquid CL because the plating apparatus 100 includes the partition structures 224 disposed on the bottom portion 222. The lip seal structure 220 may include an insulating material such as rubber, and may be electrically insulated from the cathode 212 and the conductive liquid CL.

Figure 3:
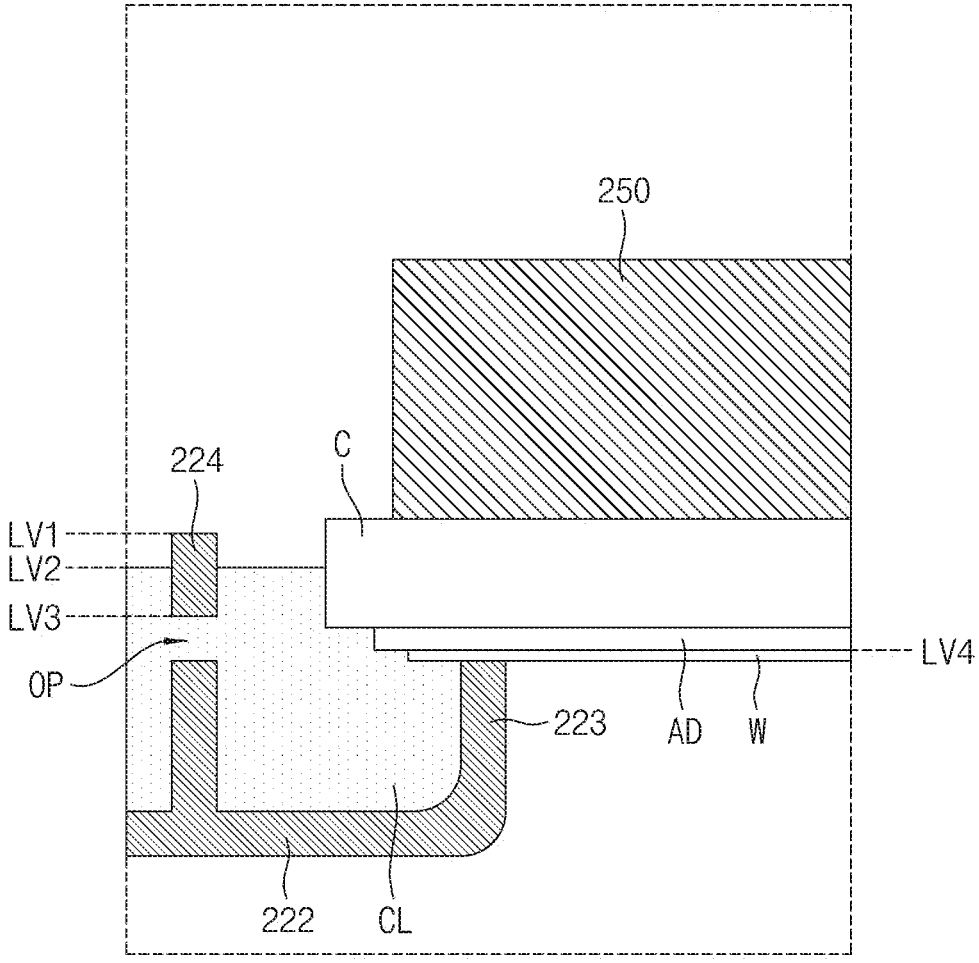
FIG. 3 is an enlarged view of the lip seal structure shown in FIG. 2.

FIG. 3 is an enlarged view of the lip seal structure 220 shown in FIG. 2.

Referring to FIG. 3, a wafer W may be bonded to the bottom of the carrier C by an adhesive layer AD. In order to prevent or reduce biasing of the conductive liquid CL, the partition structure 224 may not completely sink in the conductive liquid CL. For example, a vertical level LV1 of an upper surface of the partition structure 224 may be higher than a liquid level LV2 of the conductive liquid CL. In addition, for electrical interconnection of the wafer W and the cathode 212, the conductive liquid CL should be movable through the opening OP without being spatially separated by the partition structure 224. For example, the liquid level LV2 of the conductive liquid CL may be higher than a vertical level LV3 of the opening OP. Here, the vertical level LV3 of the opening OP may mean a vertical level at an upper end of the opening OP. The wafer W may completely sink in the conductive liquid CL in order to sufficiently contact the conductive liquid CL. For example, the liquid level LV2 of the conductive liquid CL may be higher than a vertical level LV4 of the wafer W. Here, the vertical level LV4 of the wafer W may mean a vertical level at an upper surface of the wafer W. The adhesive layer AD may also completely sink in the conductive liquid CL, and the carrier C may partially sink in the conductive liquid CL. In an embodiment, the thickness of the wafer W may be 18 to 54 μm.

Before execution of the plating process, the carrier C may be pressed by the pressing member 250 such that the wafer W is brought into close contact with the contact portion 223 of the lip seal structure 220, in order to limit and/or prevent the plating solution E from flowing to an upper surface of the lip seal structure 220. When a solid electrode is used, a lower surface of the wafer W may be damaged by the solid electrode. However, the plating apparatus 100 according to example embodiments of inventive concepts uses the conductive liquid CL as an electrode and, as such, it may be possible to not only supply current to the wafer W, but also to prevent or reduce damage to the wafer W.

Figure 4:
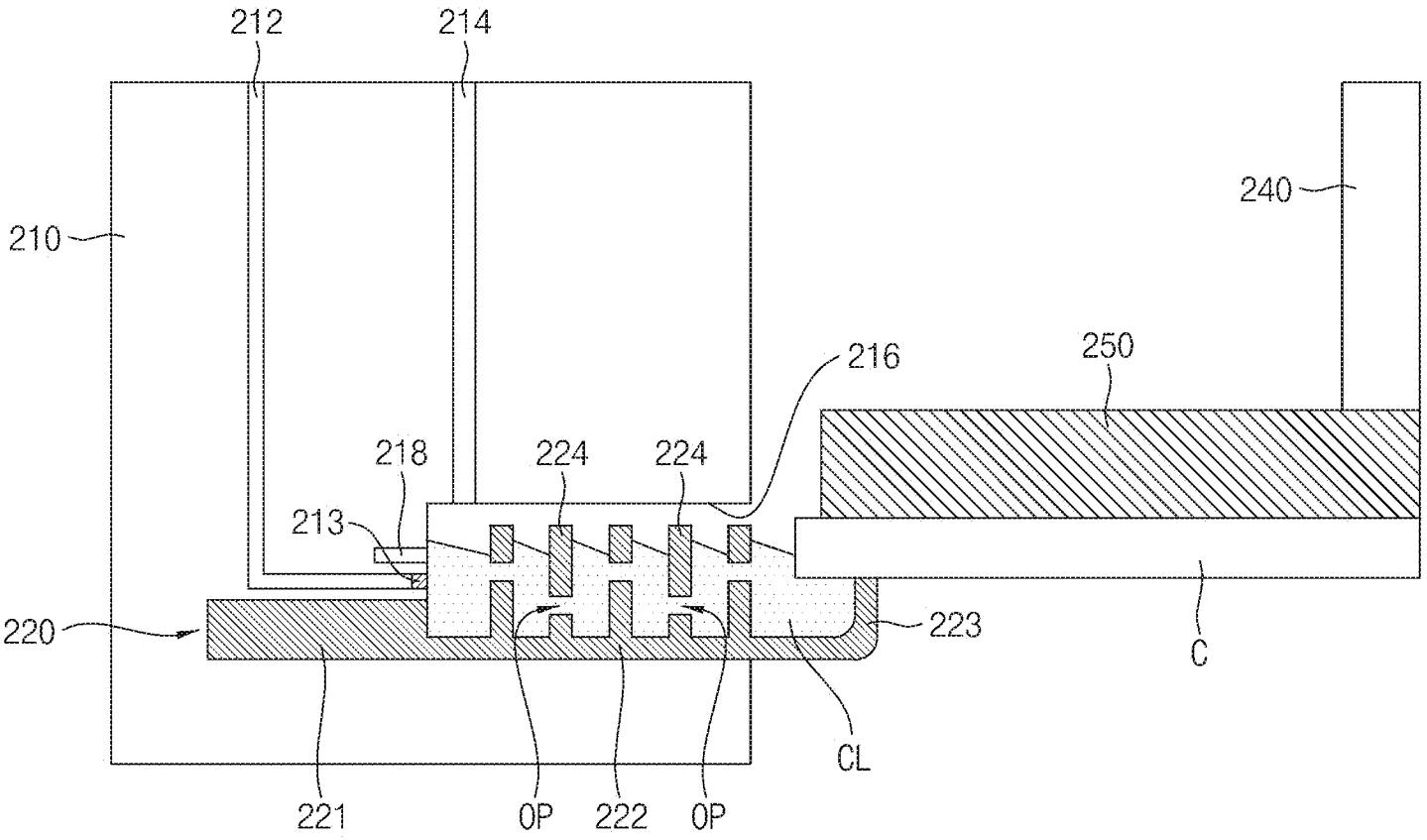
FIG. 4 is a cross-sectional view of a plating apparatus according to an example embodiment of inventive concepts.

FIG. 4 is a cross-sectional view of a plating apparatus according to an example embodiment of inventive concepts. FIG. 4 shows a liquid level of a conductive liquid CL when a plating process is performed.

Referring to FIG. 4, a carrier C and a body 210 may be rotated by a spindle 240. The conductive liquid CL on a lip seal structure 220 may be biased in a direction away from the carrier C by centrifugal force. However, partition structures 224 may restrict movement of the conductive liquid CL and, as such, a variation in liquid level of the conductive liquid CL may be reduced, and a contact state between a wafer W and the conductive liquid CL may be maintained.

Figure 5:
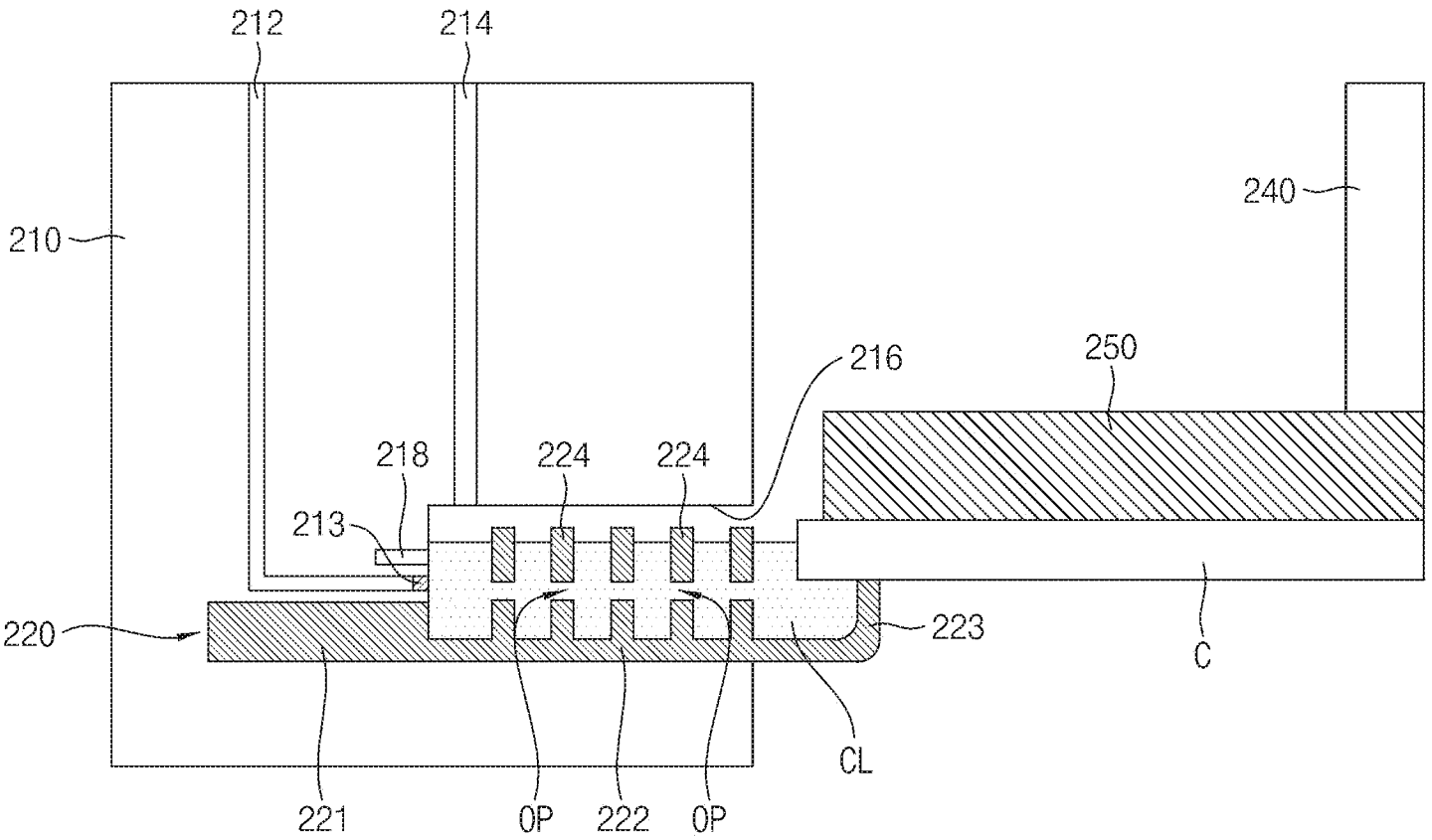
FIG. 5 is a cross-sectional view of a plating apparatus according to an example embodiment of inventive concepts.

FIG. 5 is a cross-sectional view of a plating apparatus according to an example embodiment of inventive concepts.

Referring to FIG. 5, in an embodiment, openings OP of partition structures 224 may be disposed at the same vertical level. However, FIG. 5 is a conceptual view for showing that the openings OP are disposed at the same vertical level, and a lip seal structure 220 may extend in a vertical direction, and the openings OP may be disposed to be misaligned from one another in a horizontal direction, as will be described later.

Figure 6:
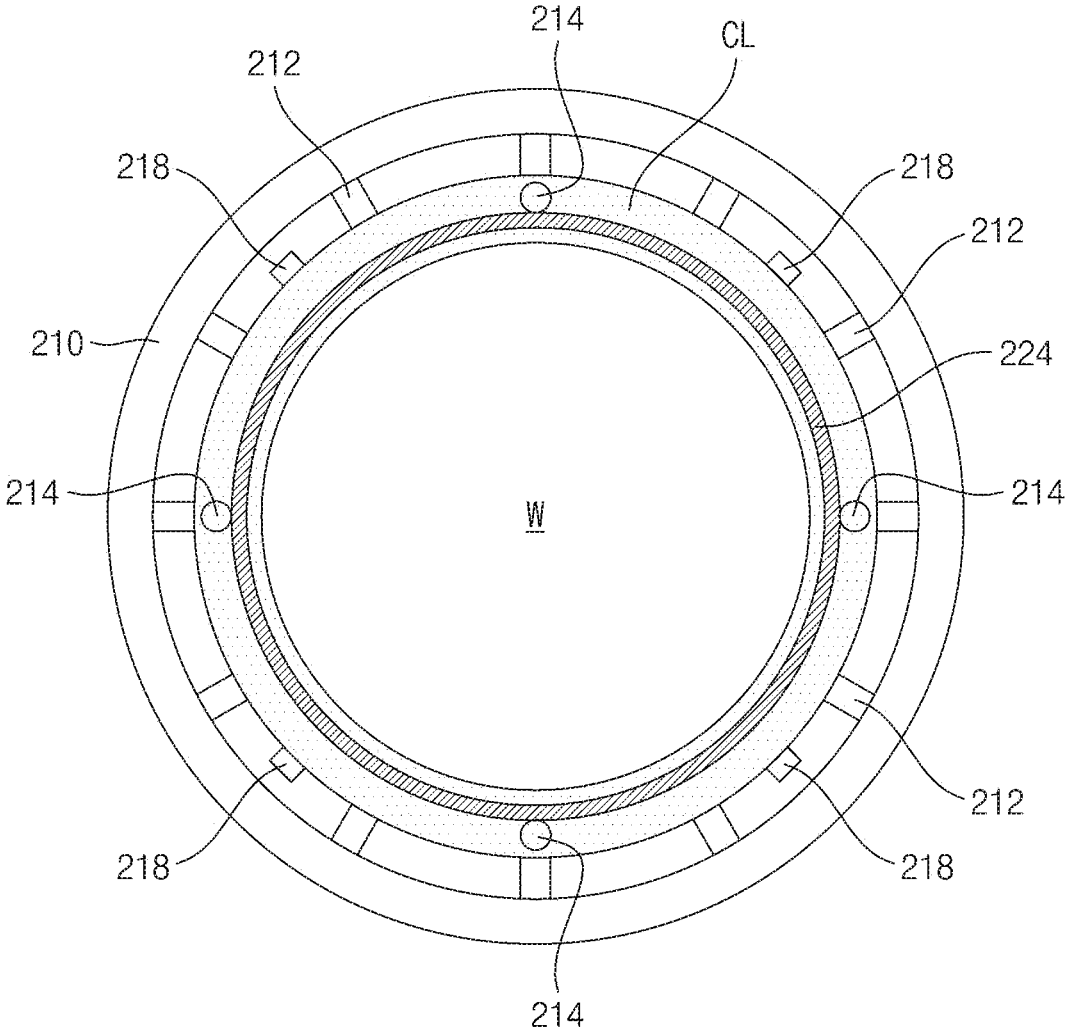
FIG. 6 is a plan view of a plating apparatus according to an example embodiment of inventive concepts.

FIG. 6 is a plan view of a plating apparatus according to an example embodiment of inventive concepts. For example, FIG. 6 is a plan view of a wafer W, a body 210 and a lip seal structure 220 viewed at a bottom side. For convenience of description, only a partition structure 224 of the lip seal structure 220 is shown.

Referring to FIG. 6, the body 210 may extend along a circumference of the wafer W in a horizontal direction, for example, a circumferential direction. The body 210 may have a ring shape or a donut shape in plan view. As described above, the body 210 may include a cathode 212, a nozzle 214 and a level sensor 218 which are exposed to a cavity 216. Although not shown, the cavity 216 may extend along the circumference of the wafer W in the circumferential direction. A conductive liquid CL may be disposed on a bottom portion (not shown) of the lip seal structure 220 which is disposed at the cavity 216, and may be disposed to extend in the circumferential direction while partially contacting the circumference of the wafer W.

In an embodiment, a plurality of cathodes 212 may be disposed at the circumference of the wafer W in order to supply uniform current to the conductive liquid CL. For example, the plurality of cathodes 212 may be disposed to be spaced apart from one another by a uniform distance along the circumference of the wafer W. In addition, as described above, an anti-corrosive layer 213 may be formed at one end of each cathode 212. In an embodiment, a plurality of nozzles 214 may be disposed at the circumference of the wafer W in order to uniformly supply the conductive liquid CL onto the lip seal structure 220. For example, the plurality of nozzles 214 may be disposed to be spaced apart from one another by a uniform distance along the circumference of the wafer W. In an embodiment, a plurality of level sensors 218 may be disposed at the circumference of the wafer W. The plurality of level sensors 218 may be used to determine a liquid level of the conductive liquid CL in more detail. For example, when the liquid level of the conductive liquid CL is lower than the vertical level of at least one of the level sensors 218, no plating process may be performed. In addition, the plurality of level sensors 218 may be spaced apart from one another by a uniform distance along the circumference of the wafer W. Although twelve cathodes 212, four nozzles 214, and four level sensors 218 are illustrated in FIG. 6, example embodiments of the disclosure are not limited thereto.

In an embodiment, the partition structure 224 may surround the wafer W, and may extend along the circumference of the wafer W in the circumferential direction. In plan view, the partition structure 224 may have a ring shape or a donut shape having a uniform thickness. Although only one partition structure 224 is illustrated in FIG. 6, example embodiments of the disclosure are not limited thereto. In some embodiments, a plurality of partition structures 224 may be concentrically disposed. The partition structure 224 may also include one or more openings OP.

FIGS. 7 to 11 are perspective views of lip seal structures according to example embodiments of inventive concepts, respectively. Although two partition structures disposed adjacent to each other are shown in FIGS. 7 to 11, example embodiments of the disclosure are not limited thereto. In some embodiments, the lip seal structures may include three or more partition structures.

Figure 7:
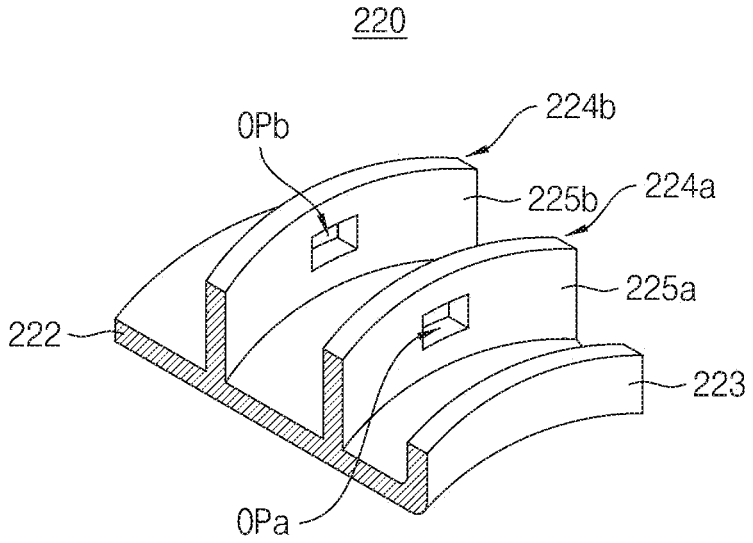
FIGS. 7 to 11 are perspective views of lip seal structures according to example embodiments of inventive concepts, respectively.

Referring to FIG. 7, a lip seal structure 220 may include a bottom portion 222, a contact portion 223, a first partition structure 224*a*, and a second partition structure 224*b*. As described above, the lip seal structure 220 may extend along a circumference of a wafer W in a circumferential direction, and the bottom portion 222 may have a ring shape or a donut shape. The contact portion 223 may extend in the circumferential direction while contacting the circumference of the wafer W.

The first partition structure 224*a* and the second partition structure 224*b* may extend in the circumferential direction. For example, the first partition structure 224*a* and the second partition structure 224*b* may include a first facing surface 225*a* and a second facing surface 225*b* facing the wafer W, respectively, and each of the first facing surface 225*a* and the second facing surface 225*b* may be a curved surface. The first partition structure 224*a* and the second partition structure 224*b* may include a first opening OPa and a second opening OPb, respectively. In an embodiment, the first opening OPa and the second opening OPb may be aligned with each other in any one of the circumferential direction and a vertical direction, without being limited thereto. The first opening OPa and the second opening OPb may have a quadrangular cross-section. In some embodiments, the cross-sections of the first opening OPa and the second opening OPb may have a shape such as a polygonal shape, a circular shape, an oval shape, etc.

Figure 8:
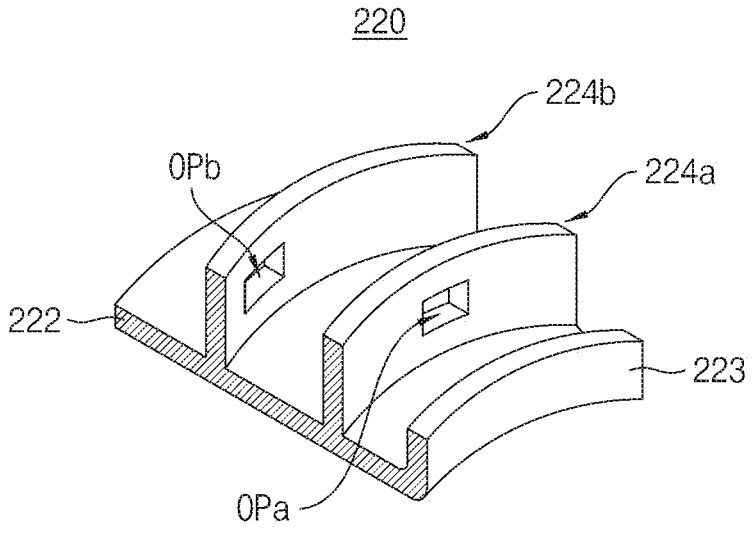

Referring to FIG. 8, a first partition structure 224*a* may include a first opening OPa, and a second partition structure 224*b* disposed adjacent to the first partition structure 224*a* may include a second opening OPb. In an embodiment, the first opening OPa and the second opening OPb may be disposed to be misaligned from each other in a circumferential direction. Movement of a conductive liquid CL may be restricted between the first partition structure 224*a* and the second partition structure 224*b* and, as such, it may be possible to reduce a variation in liquid level of the conductive liquid CL caused by centrifugal force. The first opening OPa and the second opening OPb may also be disposed to be misaligned from each other in a vertical direction, without being limited thereto.

Figure 9:
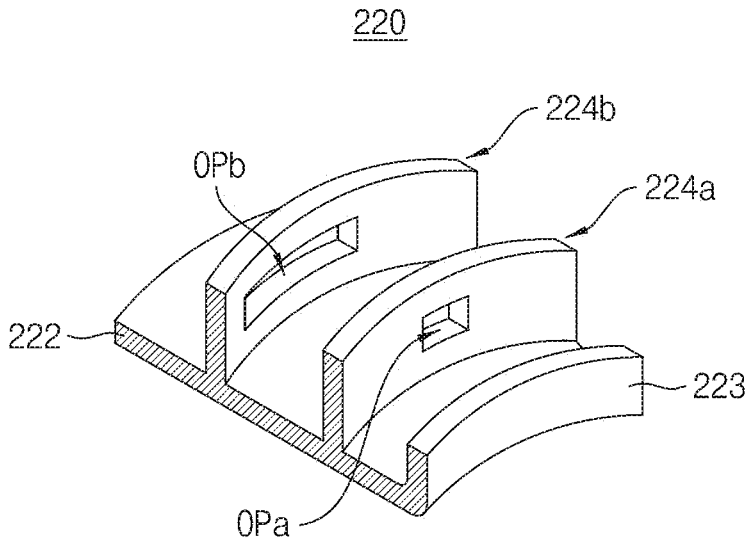

Referring to FIG. 9, a first partition structure 224*a* and a second partition structure 224*b* may include a first opening OPa and a second opening OPb, respectively. In an embodiment, the first opening OPa and the second opening OPb may have different sizes, respectively. For example, cross-sections of the first opening OPa and the second opening OPb may be quadrangular, and the horizontal width of the second opening OPb may be greater than the horizontal width of the first opening OPa. In some embodiments, as described above, the first opening OPa and the second opening OPb may have a shape such as a polygonal shape, a circular shape, an oval shape, etc., and the cross-sectional area of the first opening OPa may be different from the cross-sectional area of the second opening OPb.

Figure 10:
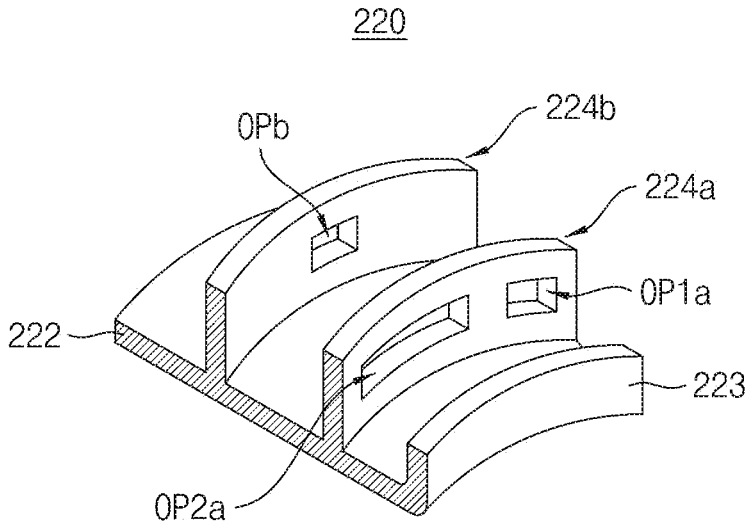

Referring to FIG. 10, a first partition structure 224*a* may include a first opening OP1*a* and a second opening OP2*a*. In an embodiment, the first opening OP1*a* and the second opening OP2*a* may have different sizes, respectively. For example, cross-sections of the first opening OP1*a* and the second opening OP2*a* may be quadrangular, and the horizontal width of the second opening OP2*a* may be greater than the horizontal width of the first opening OP1*a*.

Figure 11:
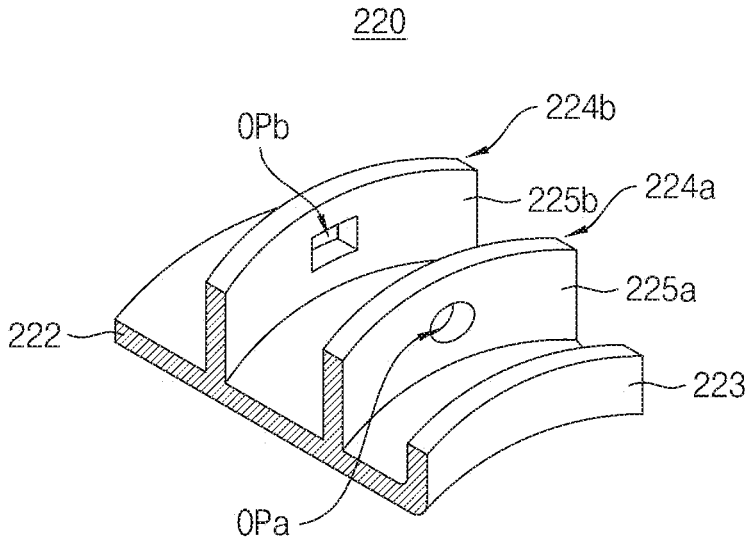

Referring to FIG. 11, a first partition structure 224*a* may include a first opening OPa. In an embodiment, the cross-section of the first opening OPa may have a circular shape or an oval shape. In some embodiments, the first opening OPa and the second opening OPb may have different cross-sectional shapes, respectively. For example, the cross-section of the second opening OPb may be quadrangular.

Figure 12:
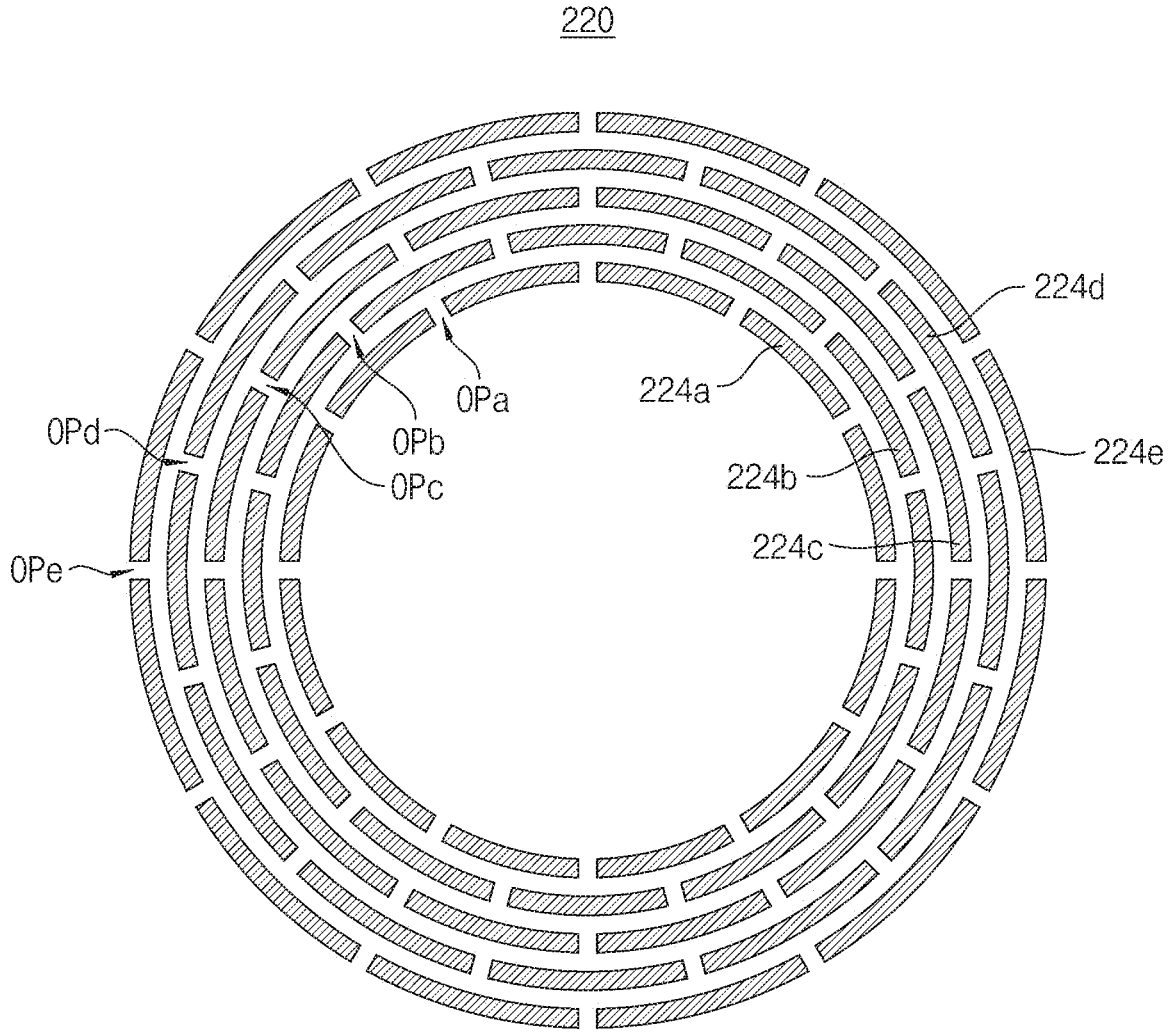
FIG. 12 is a plan view of partition structures according to an example embodiment of inventive concepts.

FIG. 12 is a plan view of partition structures according to an example embodiment of inventive concepts.

Referring to FIG. 12, in an embodiment, a lip seal structure 220 may include first to fifth partition structures 224*a*, 224*b*, 224*c*, 224*d*, and 224*e*. The first to fifth partition structures 224*a*, 224*b*, 224*c*, 224*d*, and 224*e* may extend in a circumferential direction, and may be concentrically disposed. The first to fifth partition structures 224*a*, 224*b*, 224*c*, 224*d*, and 224*e* may include pluralities of first to fifth openings OPa, OPb, OPc, OPd, and OPe, respectively. For example, the first openings OPa may be formed at the first partition structure 224*a*, and may be disposed in the circumferential direction. In an embodiment, the first openings OPa may be disposed to be spaced apart from one another by a uniform distance in the circumferential direction. Similarly, the second to fifth openings OPb, OPc, OPd, and OPe OPa may also be disposed to be spaced apart from one another by a uniform distance in the circumferential direction. In an embodiment, the openings formed at adjacent ones of the partition structures may be disposed to be spaced apart from each other. For example, the first partition structure 224*a* may be adjacent to the second partition structure 224*b* in a diametric direction intersecting the circumferential direction, and each of the first openings OPa formed at the first partition structure 224*a* may be disposed to be misaligned with the second openings OPb formed at the second partition structure 224*b* in the circumferential direction. Similarly, each of the second openings OPb may be disposed to be misaligned from the third openings OPc in the circumferential direction, each of the third openings OPc may be disposed to be misaligned from the fourth openings OPd in the circumferential direction, and each of the fourth openings OPd may be disposed to be misaligned from the fifth openings OPe in the circumferential direction. Although the first to fifth openings OPa, OPb, OPc, OPd, and OPe are shown in FIG. 11 as having the same size, example embodiments of the disclosure are not limited thereto.

Figure 13:
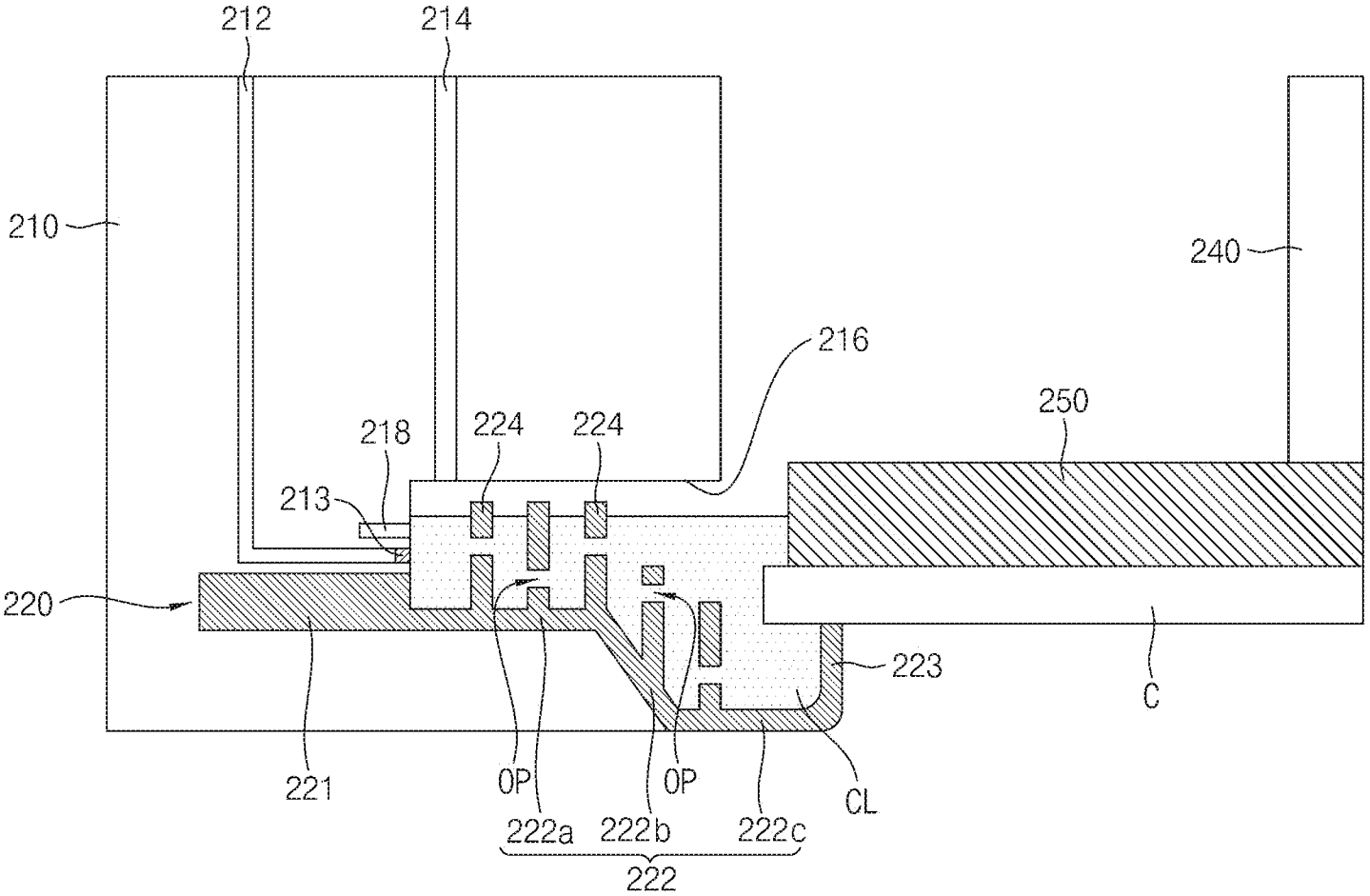
FIGS. 13 and 14 are cross-sectional views of plating apparatuses according to example embodiments of inventive concepts, respectively.
Figure 14:
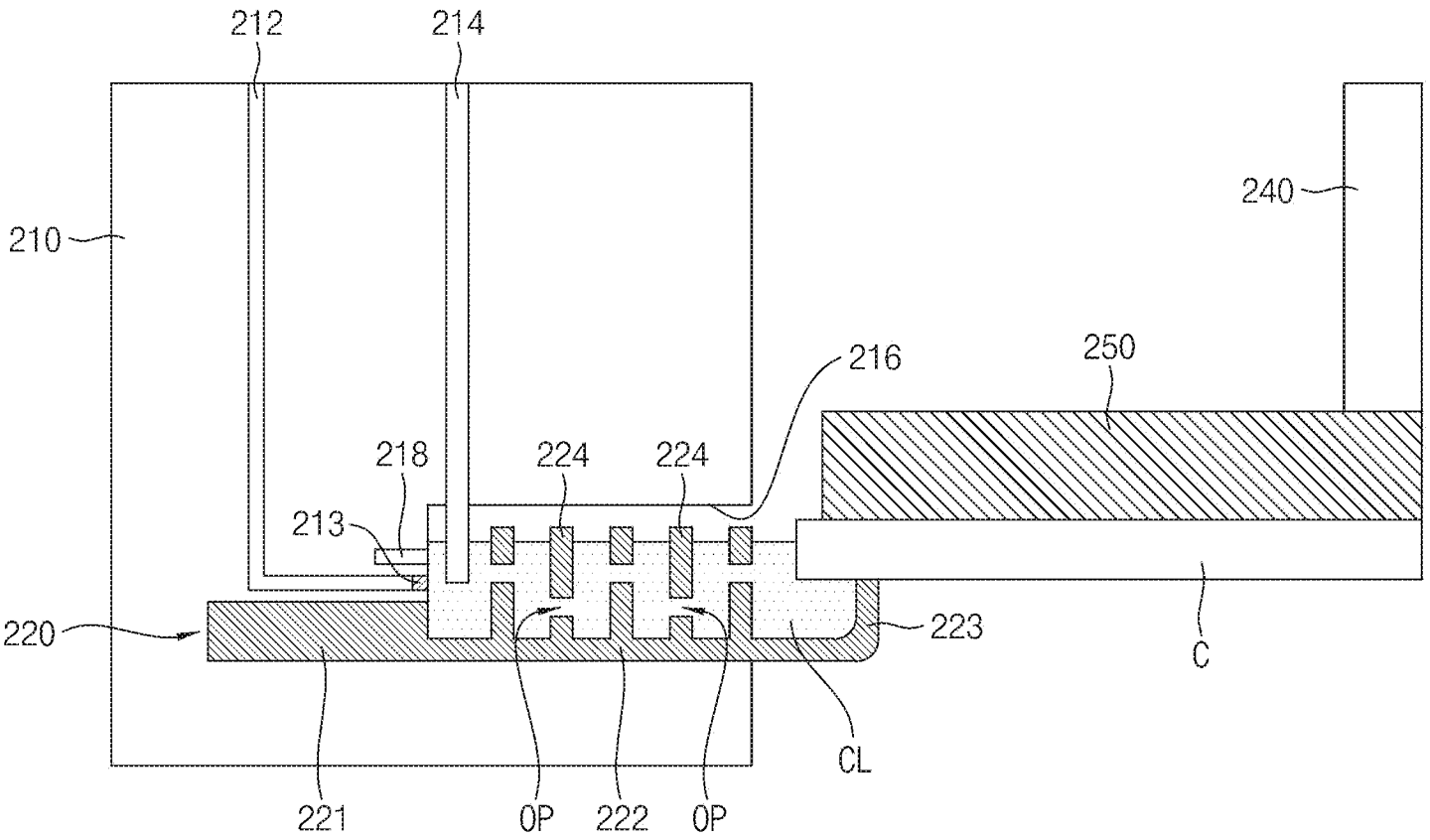

FIGS. 13 and 14 are cross-sectional views of plating apparatuses according to example embodiments of inventive concepts, respectively.

Referring to FIG. 13, in an embodiment, a bottom portion 222 of a lip seal structure 220 may include a first bottom portion 222*a*, a second bottom portion 222*b*, and a third bottom portion 222*c*. The first bottom portion 222*a* may be connected to a buried portion 221, a third bottom portion 222*c* may be connected to a contact portion 223, and the second bottom portion 222*b* may be disposed between the first bottom portion 222*a* and the third bottom portion 222*c*. The second bottom portion 222*b* may be inclined, and the first bottom portion 222*a* and the third bottom portion 222*c* may extend in a horizontal direction. For example, the third bottom portion 222*c* may be disposed at a lower level than the first bottom portion 222*a*.

Since the third bottom portion 222*c* connected to the contact portion 223 is disposed at a lower level than the first bottom portion 222*a*, a carrier C or a wafer W may completely sink in a conductive liquid CL and, as such, a contact state between the conductive liquid CL and the wafer W may be maintained. In an embodiment, an upper end of the contact portion 223 may be disposed at a lower level than an upper surface of the first bottom portion 222*a*.

Referring to FIG. 14, a body 210 may include a nozzle 214 configured to supply and recover a conductive liquid CL. After completion of a plating process, a pressing member 250 may be moved upwards or downwards, thereby moving a wafer W upwards. In an embodiment, the nozzle 214 may recover the conductive liquid CL on a lip seal structure 220 before upward movement of the wafer W and upward or downward movement of the pressing member 250. Accordingly, introduction of the conductive liquid CL into a plating solution E of a plating bath 300 may be prevented or reduced. In order to recover the conductive liquid CL, one end of the nozzle 214 may be disposed at a lower level than a liquid level of the conductive liquid CL. In addition, the one end of the nozzle 214 may be disposed at a lower level than a level sensor 218.

Figure 15:
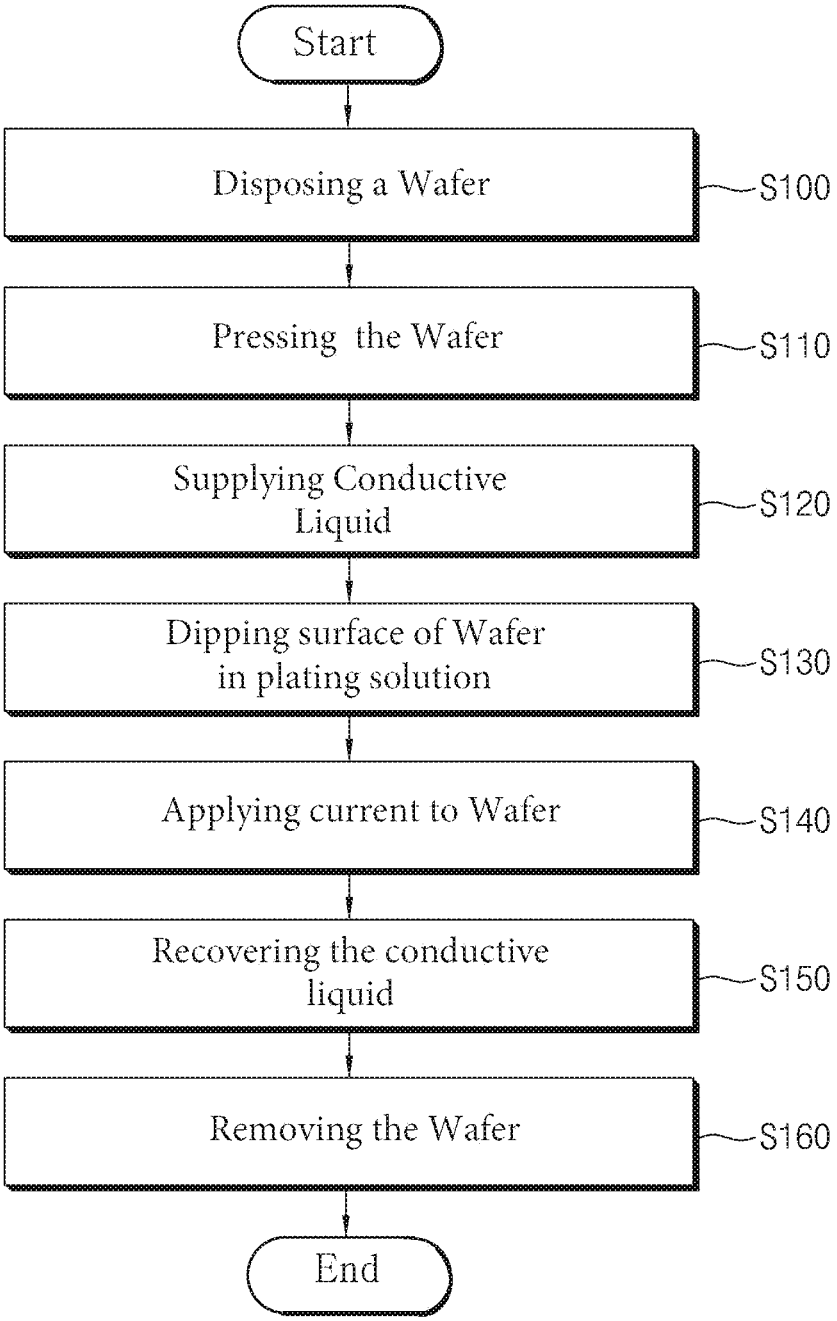
FIG. 15 is a flowchart of a plating method according to an example embodiment of inventive concepts.

FIG. 15 is a flowchart of a plating method according to an example embodiment of inventive concepts.

Referring to FIG. 15, the plating method may include disposing a wafer W at a substrate holder 200 (S100), pressing the wafer W by a pressing member 250 (S110), supplying a conductive liquid CL onto a lip seal structure 220 (S120), dipping one surface of the wafer W in a plating solution E (S130), forming a plated film on the one surface of the wafer W (S140), recovering the conductive liquid CL (S150), and removing the wafer W (S160).

Disposing the wafer W at the substrate holder 200 (S100) may include providing the wafer W to an interior of the substrate holder 200, and seating the wafer W on the lip seal structure 220. In this case, the pressing member 250 may be disposed in an upwardly-moved state. Alternatively, a body 210 may be disposed in a state of being moved downwards from an upper plate 230.

Pressing the wafer W by the pressing member 250 (S110) may include downwardly moving the pressing member 250 by a spindle 240. Alternatively, upwardly moving the body 210 in a state in which the upper plate 230 and the pressing member 250 are fixed, thereby pressing the wafer W, may be included. The pressing member 250 may press a surface of the wafer W opposite to a surface of the wafer W upon which a plating process is to be performed. The wafer W may be brought into close contact with the lip seal structure 220 by the pressing member 250.

Supplying the conductive liquid CL onto the lip seal structure 220 (S120) may include supplying the conductive liquid CL through a nozzle 214. In an embodiment, the body 210 of the substrate holder 200 may include the nozzle 214, and one end of the nozzle 214 may be exposed to a cavity 216 formed at a side surface of the body 210. The nozzle 214 may supply the conductive liquid CL to the cavity 216, and the conductive liquid CL may cover an upper surface of a bottom portion 222 and side surfaces of partition structures 224 in the lip seal structure 220. In an embodiment, a plurality of nozzles 214 may be disposed to be spaced apart from one another by a uniform distance along a circumference of the wafer W. The conductive liquid CL may include at least one of an aqueous solution of copper sulfate ($CuSO_4$), deionized water (DIW), and sulfuric acid ($H_2SO_4$).

Thereafter, the substrate holder 200 may be downwardly moved and, as such, the one surface of the wafer W may be dipped in the plating solution E (S130). The plating solution E may be contained in a plating bath 300 and, for example, may include an aqueous solution of copper sulfate ($CuSO_4$).

In an embodiment, dipping the wafer W in the plating solution E may be performed before pressing the wafer W is performed.

Subsequently, current may be applied to the wafer W and, as such, a plating film may be formed on the one surface of the wafer W (S140). In an embodiment, checking whether or not a liquid level of the conductive liquid CL is suitable (for example, whether or not the liquid level is higher than a vertical level of a level sensor 218), using the level sensor 218, may be added. For example, a plurality of level sensors 218 may be disposed to be spaced apart from one another by a uniform distance along a circumference of the wafer W, and a plating process may be performed after checking of the liquid level by each level sensor 218. The liquid level may be measured in a state in which the substrate holder 200 and the wafer W have been rotated by the spindle 240.

Forming the conductive film may be performed by applying a plus potential to an anode 312 disposed in an electroplating chamber 310 of the plating bath 300 while applying a minus potential to a cathode 212 connected to the conductive liquid CL. The conductive liquid CL may electrically interconnect the cathode 212 and the wafer W and, as such, current may be transferred to the wafer W. The plated film may include, for example, copper (Cu). The plated film may form, on the wafer W, a conductive structure such as a wiring, a through-hole via (THV), and a through-silicon via (TSV).

After formation of the plated film, the conductive liquid CL may be recovered (S150). In an embodiment, the nozzle 214 may not only supply the conductive liquid CL onto the lip seal structure 220, but also may recover the conductive liquid CL. In order to recover the conductive liquid CL, one end of the nozzle 214 may sink in the conductive liquid CL. For example, the one end of the nozzle 214 may be disposed at a lower level than the vertical level of the level sensor 218 and the liquid level of the conductive liquid CL. Recovering the conductive liquid CL may be a selective process, and may be omitted in some embodiments.

Thereafter, the wafer W may be removed from the substrate holder 200 (S160). For example, the wafer W having completed the plating process may be removed from the substrate holder 200 after the pressing member 250 is upwardly moved by the spindle 240, or the body 210 moves downwards from the upper plate 230. When the conductive liquid CL is recovered, it may be possible to limit and/or prevent the conductive liquid CL from flowing into the plating solution E during removal of the wafer W.

In accordance with example embodiments of the disclosure, the plating apparatus uses a conductive liquid and, as such, damage to a wafer in a plating process may be prevented or reduced.

While some example embodiments have been described with reference to the accompanying drawings, it should be understood by those skilled in the art that various modifications may be made without departing from the spirt and scope of inventive concepts. Therefore, the above-described embodiments should be considered in a descriptive sense only and not for purposes of limitation.

What is claimed is:

1. A plating apparatus comprising:

a body including a cathode;

a lip seal structure connected to the body and configured to hold a wafer, the lip seal structure including a bottom portion, a contact portion connected to the bottom portion and configured to contact the wafer, and at least one partition structure protruding from an upper surface of the bottom portion; and a conductive liquid covering the upper surface of the bottom portion, the conductive liquid being configured to electrically connect the cathode and the wafer to each other, wherein the conductive liquid contacts both sidewalls of the partition structure, the at least one partition structure includes a first partition structure having a plurality of first openings and a second partition structure including a plurality of second openings, the second partition structure is adjacent to the first partition structure, and the plurality of first openings and the plurality of second openings are misaligned with each other in a circumferential direction.

2. The plating apparatus according to claim 1, wherein a vertical level of an upper end of the at least one partition structure is higher than a liquid level of the conductive liquid.

3. The plating apparatus according to claim 1, wherein the plating apparatus includes the wafer on the lip seal structure, and a liquid level of the conductive liquid is higher than a vertical level of the wafer.

4. The plating apparatus according to claim 1, wherein an upper end of the at least one partition structure is at a higher level than an upper end of the contact portion.

5. The plating apparatus according to claim 1, wherein the body includes a cavity containing the at least one partition structure and the conductive liquid therein.

6. The plating apparatus according to claim 1, wherein the plating apparatus includes the wafer on the lip seal structure, and the at least one partition structure extends in a circumferential direction to surround the wafer.

7. The plating apparatus according to claim 6, wherein the plating apparatus includes the wafer on the lip seal structure, and the at least one partition structure includes a facing surface, the facing surface faces the wafer, and the facing surface is a curved surface.

8. A plating apparatus comprising:

a body including a cathode;

a lip seal structure connected to the body and configured to hold a wafer, the lip seal structure including a bottom portion, a contact portion connected to the bottom portion and configured to contact the wafer, and at least one partition structure protruding from an upper surface of the bottom portion; and a conductive liquid covering the upper surface of the bottom portion, the conductive liquid being configured to electrically connect the cathode and the wafer to each other, wherein each of the at least one partition structure includes an opening, the at least one partition structure is a plurality of partition structures, the plurality of partition structures include openings, and the openings of adjacent partition structures among the plurality of partition structures are misaligned from each other in a vertical direction or the openings of adjacent partition structures among the plurality of partition structures are misaligned from each other in a circumferential direction.

9. The plating apparatus according to claim 8, wherein a liquid level of the conductive liquid is higher than a vertical level of the opening.

10. The plating apparatus according to claim 8, wherein the openings of adjacent partition structures among the plurality of partition structures are misaligned from each other in the vertical direction.

11. The plating apparatus according to claim 8, wherein the openings of adjacent partition structures among the plurality of partition structures are misaligned from each other in the circumferential direction.

12. The plating apparatus according to claim 8, wherein the at least one partition structure includes a first partition structure having a first opening and a second partition structure having a second opening, and the first opening of the first partition structure is smaller than the second opening of the second partition structure.

13. The plating apparatus according to claim 8, wherein the at least one partition structure includes a first opening and a second opening, and the first opening of the at least one partition structure is smaller than the second opening of the at least one partition structure.

14. The plating apparatus according to claim 1, wherein the plurality of first openings are spaced apart from one another by a uniform distance in the circumferential direction, and the plurality of second openings are spaced apart from one another by a uniform distance in the circumferential direction.

15. The plating apparatus according to claim 14, wherein:

the bottom portion includes a first bottom portion and a second bottom portion, a level of the second bottom portion is lower than a level of the first bottom portion, the second bottom portion is connected to the contact portion, and an upper end of the contact portion is at a lower level than an upper surface of the first bottom portion.

16. The plating apparatus according to claim 1, wherein the conductive liquid includes at least one of an aqueous solution of copper sulfate ($CuSO_4$), deionized water (DIW), and sulfuric acid ($H_2SO_4$).

17. A plating apparatus comprising:

a body including a cavity at a surface configured to face a wafer, the body further including at least one cathode, at least one nozzle, and at least one level sensor in fluid communication with the cavity;

a lip seal structure connected to the body and configured to hold the wafer, the lip seal structure including a bottom portion, a contact portion connected to the bottom portion and configured to contact the wafer, and at least one partition structure protruding from an upper surface of the bottom portion; and a conductive liquid covering the upper surface of the bottom portion and configured to electrically connect the cathode and the wafer to each other, wherein the conductive liquid contacts both sidewalls of the partition structure, each of the at least one partition structure includes an opening, the at least one partition structure is a plurality of partition structures, the plurality of partition structures include openings, and the openings of adjacent partition structures among the plurality of partition structures are misaligned from each other in a circumferential direction.

18. The plating apparatus according to claim 17, wherein the at least one cathode includes a plurality of cathodes spaced apart from one another by a uniform distance in the circumferential direction;

the at least one nozzle includes a plurality of nozzles spaced apart from one another by a uniform distance in the circumferential direction; and the at least one level sensor includes a plurality of level sensors spaced apart from one another by a uniform distance in the circumferential direction.

19. The plating apparatus according to claim 17, wherein a lower end of the at least one nozzle is at a lower level than a liquid level of the conductive liquid, and the at least one nozzle is configured to supply and recover the conductive liquid to and from the cavity.

* * * * *